US005452553A

United States Patent [19]

Clapp et al.

[11] Patent Number: 5,452,553

[45] Date of Patent: Sep. 26, 1995

[54] WATERPROOF COVERINGS FOR GENERALLY FLAT OR LOW-PITCH ROOFS ON BUILDINGS

[76] Inventors: Guy C. Clapp, 5412 Hidden Oaks La.; Benjamin L. Doskocil, 5306 Mansfield Rd., both of Arlington, Tex. 76017

[21] Appl. No.: 119,549

[22] Filed: Sep. 13, 1993

[51] Int. Cl.[6] ..... E04D 3/18

[52] U.S. Cl. ..... 52/408; 52/410; 52/460; 52/469; 52/549

[58] Field of Search ..... 52/408, 409, 410, 52/460, 465, 469, 537, 549, 741.4, 746; 156/71, 92

[56] References Cited

U.S. PATENT DOCUMENTS

| | | | |
|---|---|---|---|
| 2,036,123 | 3/1936 | Dahlander | 52/746 |
| 2,427,273 | 9/1947 | Goble | 52/408 |
| 3,643,388 | 2/1972 | Parr et al. | 52/741.4 X |
| 4,441,295 | 4/1984 | Kelly | 52/408 |
| 4,519,175 | 5/1985 | Resan | 52/410 X |
| 4,522,004 | 6/1985 | Evans et al. | 52/409 |
| 4,630,421 | 12/1986 | Diehl et al. | 52/408 |
| 4,686,809 | 8/1987 | Skelton | 52/537 X |
| 4,712,348 | 12/1987 | Triplett et al. | 52/408 |
| 4,736,552 | 4/1988 | Ward et al. | 52/408 X |
| 4,825,613 | 5/1989 | Verble | 52/408 |

FOREIGN PATENT DOCUMENTS

| | | | |
|---|---|---|---|
| 3615466 | 11/1987 | Germany | 52/746 |

*Primary Examiner*—Carl D. Friedman
*Assistant Examiner*—Kevin D. Wilkens
*Attorney, Agent, or Firm*—Charles W. McHugh

[57] ABSTRACT

A waterproof cover having special utility for a flat or low-slope roof for a building. The roof includes a structural part comprising beams, joists, rafters, etc., as well as a substrate in the form of plywood panels, metal decking, etc. A waterproof cover is secured over the substrate. The cover is formed by placing a plurality of waterproof sheets loosely over the structural substrate, and connecting the abutting edges of adjacent sheets to one another, much like an old-fashion quilt is assembled. The preferred sheets constitute lightweight, thin but relatively stiff sheets of resin-impregnated fiberglass having a thickness of about 0.065 inch; and the joints between adjacent sheets are formed in situ by a mixture of fiberglass fibers and cured resin. The plurality of sheets are joined to one another (along their abutting edges) to form one giant waterproof cover. To accommodate dimensional changes that will inevitably arise during the life of the cover, there is deliberately built into the cover an excess of material that can compensate for anticipated contractions and expansions due to thermal changes, foundation shifting, etc. This excess of material is created by placing a plurality of removable supports under the sheets before they are mechanically anchored to the substrate. The preferred supports are ropes which can be strung out both longitudinally and transversely on top of a substrate before the sheets are initially put into position; after the sheets have been securely anchored to the substrate, the ropes are then pulled out.

20 Claims, 3 Drawing Sheets

FIG. 3
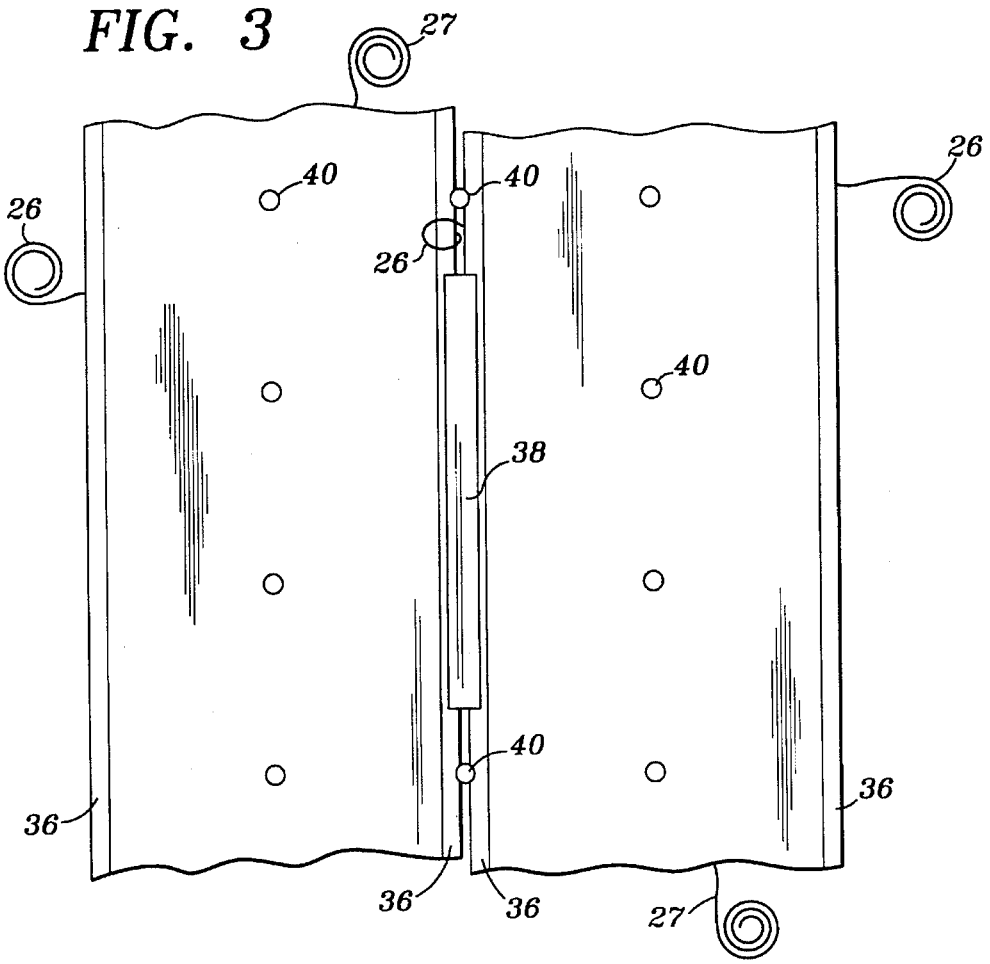
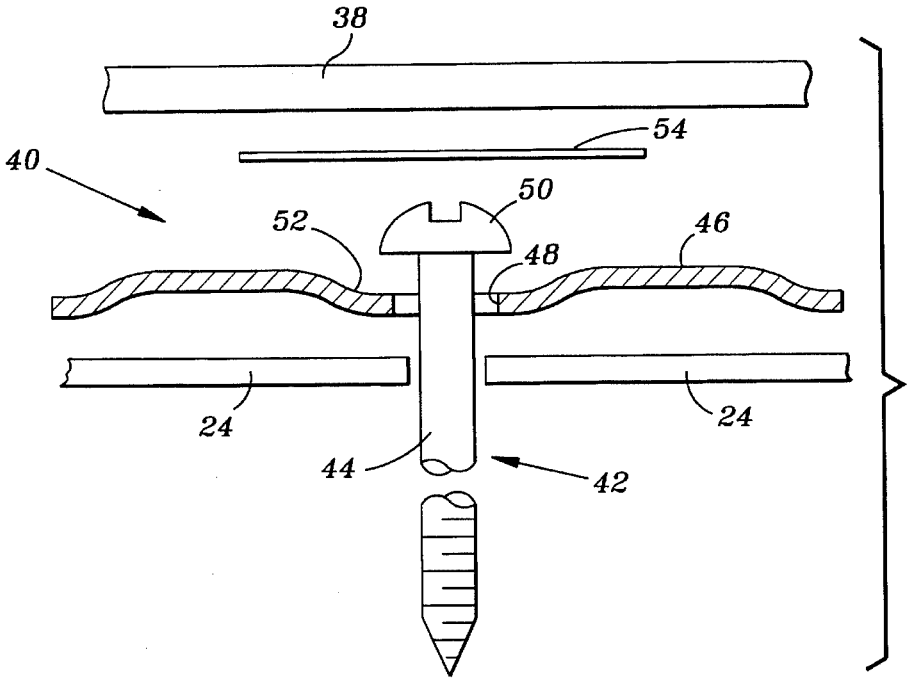
FIG. 5

WATERPROOF COVERINGS FOR GENERALLY FLAT OR LOW-PITCH ROOFS ON BUILDINGS

FIELD OF THE INVENTION

This invention relates generally to a waterproof covering for the roof of a building, especially a building having what is called a generally flat (or low-pitch) roof. More specifically, the invention relates to a waterproof covering that is generally planar and that has significant stiffness when examined in a direction that is parallel to the approximate plane in which the cover lies. However, the covering is designed to be bent at least somewhat in a direction that is perpendicular to the approximate plane in which the cover lies.

BACKGROUND OF THE INVENTION

It is well known to construct generally flat roofs on some buildings, especially commercial buildings having a roof area of several hundreds or thousands of square feet. (The phrase "flat roof" is being used herein in the manner in which many people customarily refer to roofs that are at least generally planar and essentially horizontal—not just planar.) It is also known to try to make flat roofs weather-tight by providing what is called a built-up series of horizontal layers of felt and the like, sealed with asphalt (or bitumen), and covered with gravel, etc. However, such built-up roofs are seldom effective in remaining water-tight for more than a few years; and depending on seasonal variations in temperature, sometimes even a single year can constitute the effective life of a roof—before it needs repair. One measure of the confidence that professional roofers have in their work is the length of time that they will put into a written guarantee of a flat roof when they install it. A few roofers may guarantee their work for several years, but others may offer a guaranty of only one year; some may even opt for their own financial security (or that of their business) by putting no guaranty on their work other than the fact that the roof won't leak on the day that they finish their job.

There are probably three primary masons why roofers are reluctant to take on the financial gamble of guaranteeing the long-term integrity of a flat roof. First, roofers generally have no control over the quality of a building's foundation, and they can never know with certainty whether the foundation will support a building with the rigidity that will ensure that a roof will not be subjected to the destructive shifting that will create major stresses and eventual fissures. Certainly, if a building is going to shift on an unstable foundation, a roof that is not flexible will not be able to move in such a way that it has some chance at remaining intact. Second, over time, a roof will inevitably be subjected to major stresses because of ordinary temperature changes, even if a building's foundation and superstructure remain relatively stable. Because the roof is located at the top of a building, it often is not shaded by anything; and a very large roof may change size by several inches in a single day—as it cools to, say, 65° F. at night and warms to 95° F. the next afternoon. Even more rapid changes can occur if a thunderstorm pours cooling rain onto a hot roof on a building in the middle of August, when the temperature in the shade (in a place like the Southwestern United States) is over 100° F. Any quick changes in the temperature of a rigid roof can introduce the kind of expansion and contraction that will almost surely create cracks, which will eventually allow rain water to flow into a building. Third, roofs of the prior art have been particularly susceptible to damage as a result of exposure to ultraviolet (abbreviated "UV") radiation, and it is hard for a roofer to anticipate how much UV radiation can be expected, or how it will affect a given roofing material.

It should not be surprising, therefore, that there has been a need for an improved technique for covering the generally flat (or low-pitch) roof of a building with a waterproof cover that is not subject to failure as a result of normal environmental conditions. And it is an object of this invention to provide such a technique. But it probably should be acknowledged at this point that others have not been totally inactive in this field. Indeed, U.S. Pat. No. 4,965,977 to White entitled "Insulated Panelized Roofing System" provides a description of at least four types of "commercial" constructions for flat or low-slope roofs: 1) torched-on single-ply; 2) EPDM single-ply; 3) built-up, also known as BUR; and 4) panelized. The last-named of the four types of roofs was supposedly created in order to overcome the many deficiencies of the first three. But even White acknowledges that panelized roofs have not solved all of the problems of the industry. In fact, it is believed that the 1990 characterization of the prior art by White is still valid today, and is worth repeating here: "The panelized roofing systems have suffered from numerous shortcomings including relatively high cost, difficulty in curing the panel boards, the requirement of open-torch flame application, easily damaged insulation boards, and physical irritation caused by fiberglass or rock wool insulation materials".

Because of the long-standing problems of flat and low-slope roofs of the prior art, it is believed to be clearly justified to move in a new direction for waterproof coverings for roofs. But the new construction that is to be revealed hereinafter can best be described with at least some terms (e.g., panels) that will, at first blush, sound familiar. In view of the valid criticisms by White and others, it is believed to be appropriate to point out that this is not just another rehash of a failed concept.

BRIEF DESCRIPTION OF THE INVENTION

The concept of providing a waterproof cover for a flat or low-slope roof for a building begins with conceptually dividing the "roof" into two parts that, in the past, have often been combined—but which are optimally separated. The first of the two parts is what will be referred to herein as a structural part; this part can be made of wood, steel, aluminum, structural plastics, etc., and its function is to provide the strength to support a variety of things over the building. The structural part will usually include beams, joists, rafters, etc., as well as a substrate in the form of plywood panels, metal decking or the like—which provides a base for supporting the second part and into which mechanical fasteners (e.g., nails, screws, etc.) can be driven. The second part of the two-part combination is the waterproof cover that is secured over the first part for the purpose of protecting it (and the building below it) from environmental conditions, especially including the moisture that is realized from rain and snow.

In accordance with a preferred embodiment of the invention, the cover is formed by placing a plurality of waterproof sheets loosely over the structural substrate, and then rigidly connecting the abutting edges of adjacent sheets to one another, much like an old-fashion quilt is assembled. Regardless of the size of the roof, the object is to form an essentially unitary waterproof cover over the substrate. The preferred sheets constitute lightweight, thin but relatively stiff sheets of resin-impregnated fiberglass having a thickness of about 0.065 inch; and the joints between adjacent sheets are formed in situ by a mixture of fiberglass fibers and cured resin. Before the preferred sheets are installed, they have a significant rigidity or stiffness as measured in the plane defined by the sheets; that is, the sheets can transmit a substantial force (even one that is great enough to shear metal fasteners) as long as the force is restricted to the plane of the sheets. But the sheets are also capable of being bent, at least somewhat, when they are subjected to modest loading in a direction that is perpendicular to the plane of the sheets. In this sense, the preferred sheets are not at all like a flexible membrane of rubber or the like; rather, they are more like thin-rolled sheets of metal that can be rolled into a coil for shipping. The sheets may also be considered to be similar to the lid of a corrugated cardboard box that is fixed in size but which can be bent at least somewhat to accommodate an over-size object that someone wants to stuff into the box. That is, the lid of a typical cardboard box is not capable of being stretched like a balloon, but it can usually be slightly bent in order to accommodate an over-size object.

Because the plurality of sheets are sealingly joined to one another (along their abutting edges) to form one giant waterproof cover, they would be subject to the same kinds of problems associated with roofs of the prior art—if they were secured in the same rigid manner that other roofs have been secured. Instead, the cover of this invention is designed to be anchored rather loosely to its underlying support; in one sense, the cover is installed with such looseness that it may be said to almost "float" over the structural substrate that constitutes the muscle-part of the roof. To accommodate dimensional changes that will inevitably arise during the life of the cover, there is deliberately built into the cover an excess of material that can compensate for the contractions that can be expected to occur in the winter—if the cover were to be installed in hot weather. This excess of material is created by placing a plurality of removable supports under the sheets before they are mechanically anchored to the substrate. The preferred supports are ropes which can be strung out both longitudinally and transversely on top of a substrate before the sheets are put into position over the substrate; after the sheets have been securely anchored to the substrate, the ropes are then pulled out. If the cover is installed while the weather is cold, then expansion caused by summer heat is accommodated by allowing the cover to flex upwardly between the few widely spaced places where the cover is mechanically connected to the substrate. To ensure that the cover will have the freedom to flex upwardly, the mechanical connections are arranged in a pattern that will not inhibit free expansion of the cover in an upward direction.

To expedite installation of a cover on a wide roof, it is advantageous to handle the rapid distribution of fiberglass sheets in the form of rolls, which can be fabricated to order by most major manufacturers of resin-impregnated fiberglass. Machinery is available to fabricate such rolls in 8 foot widths and lengths of 500 to 800 feet. A particularly efficacious cover material is a fiberglass sheet made of chopped fiberglass fibers bonded with polyester resin, and containing about 25% fiberglass by volume; the material has a tensile strength of about 11,000 pounds per square inch, and it has sufficient flexibility so that it can be rolled around a core having a diameter of about one foot. While such large rolls are obviously not light enough to be manually handled like a sheet of plywood, they do foster significant economies because, for one thing, material-handling equipment like a forklift can move a great quantity of material in a short period of time. Furthermore, having the fiberglass sheets furnished in roll form eliminates the time (and joint material) that would otherwise be required for a roofing crew to join the top edge of one panel to the bottom edge of an immediately adjacent panel, etc.

The novel principles of the invention will be more readily appreciated by reference to the following specification and the claims appended thereto, as well as the accompanying figures of the drawing.

BRIEF DESCRIPTION OF THE FIGURES OF THE DRAWING

FIG. 3 is a top plan view of a segment of the cover in the process of being created, and showing parts of two strips extending parallel to one another across the top of the roof, showing both transverse and longitudinal ropes that are used to hold portions of strips above a substrate;

FIG. 5, which is a cross-sectional elevational view of an exemplary anchor that is located between two of the strips that make up a cover;

DETAILED DESCRIPTION OF A PREFERRED EMBODIMENT OF THE INVENTION

Figure 1:
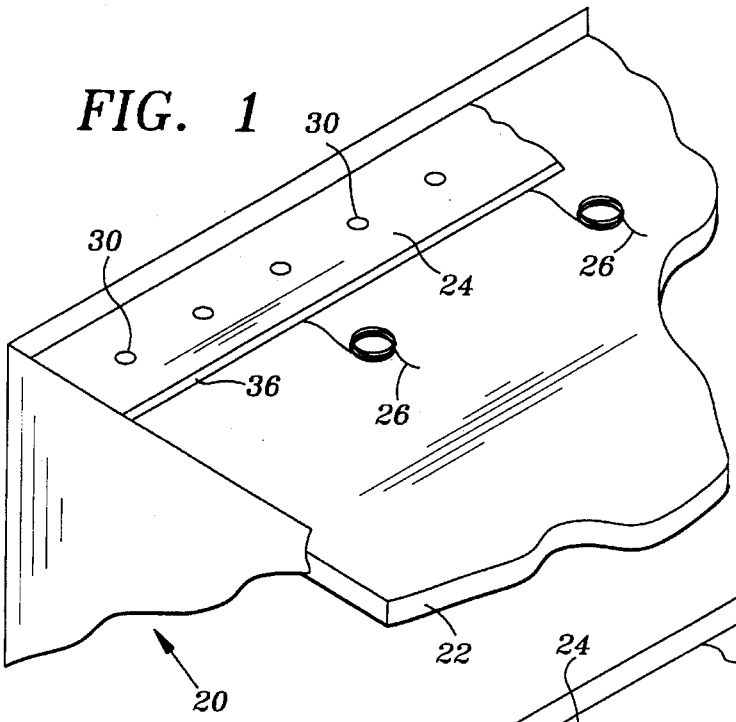
FIG. 1 is a perspective view of a small segment of a building having a large and relatively flat roof, showing a first sheet of resin-impregnated fiberglass being placed across the top of a roof substrate, and showing a plurality of transversely oriented ropes as temporary supports at spaced locations under the sheet.
Figure 2:
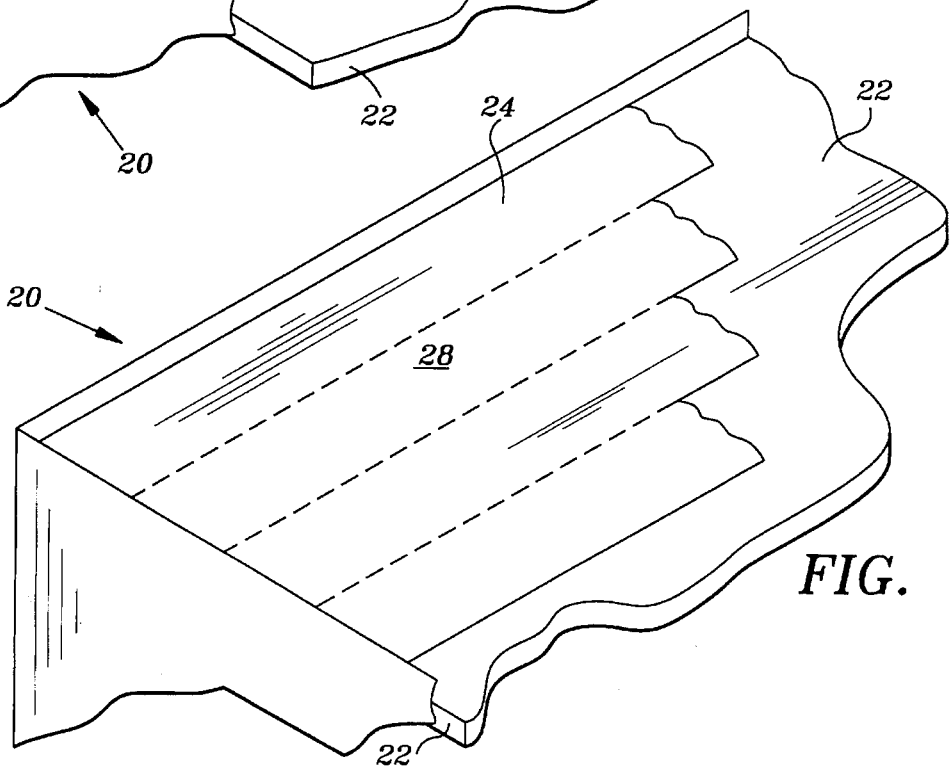
FIG. 2 is a perspective view similar to FIG. 1, and showing a series of side-by-side sheets that have been placed on top of the substrate that constitutes the structural support for the cover of the invention.

Referring initially to FIG. 1, a small section of an exemplary building 20 is shown, said building having a relatively flat (i.e., generally planar and horizontal) roof whose shape is primarily defined by what will be referred to herein as a substrate 22. The substrate 22 may be composed of a variety of elongated structural pieces such as beams, rafters, trusses, etc., as well as generally planar pieces like sheets of plywood, shaped metal, and foamed plastic panels, etc. But this invention is concerned not so much with the substrate as it is with a waterproof cover that is placed over the substrate. So as long as the substrate is sturdy and is capable of receiving and holding mechanical fasteners (e.g., nails, screws, bolts, etc.), it will likely be quite adequate as a foundation for this invention. In fact, if the cover of this invention is being applied to an existing building, it will often be possible to simply leave all of the old roof in place, and to lay the new sheets on top of the old roof, including any existing gravel and the like. This alone provides a significant financial advantage for this invention, in that the expense, delay and mess of tearing off an old roof can be avoided. However, if the gravel is not evenly distributed and reasonably level, it will be useful to sweep any loose gravel into a low spot in order to more nearly create a generally flat supporting surface for the cover.

Also shown in FIG. 1 is a resin-impregnated fiberglass strip 24 that will be the first of a plurality of side-by-side strips (or long sheets) that will extend across the generally flat roof. Assuming that the building has a fairly large roof, an exemplary strip 24 will preferably be about 8 feet wide and as long as is necessary to extend from one edge of the building to an opposite edge. If the building is more than 125 feet long, the strips 24 will usually be cut into working lengths of about 125 feet, to foster convenience in handling, etc. The working lengths will then be joined, end to end, for as many times as necessary to extend across the roof. :

A preferred material for the strips 24 is chopped E-fiberglass fibers that have been bonded together with a general purpose orthophthalic polyester (thermosetting) resin. Most of the chopped fibers will have a nominal length of about 2 inches, and the finished strips 24 will have a nominal thickness of about 0.065 inch. A preferred strip will have about 25% fiberglass (by volume), which is higher than some commercially available panels that have only 15% fiberglass; materials with the higher volume of fiberglass will expand and contract less as a result of temperature changes, and are therefore recommended for roofing applications. The preferred material will advantageously include an additive to provide protection against deterioration from ultraviolet radiation, as well as a whitening medium such as titanium dioxide. A strip's nominal weight will be slightly less than ½ pound per square foot; so an 8-foot wide strip that is 125 feet long will weigh less than 500 pounds. Such a light-weight roofing material is advantageous in that it can nearly always be accommodated in a freight elevator of a multi-story building; so a plurality of such strips could be individually hauled to the roof of an existing building in an elevator. Hence, the light weight of the fiberglass material can eliminate the need for an expensive crane to move repair materials to the roof of a multi-story building. And when a new cover is being installed over an old roof, the relatively low weight of the new cover would not impose an unreasonable burden on the support structure of the building.

Figure 6:
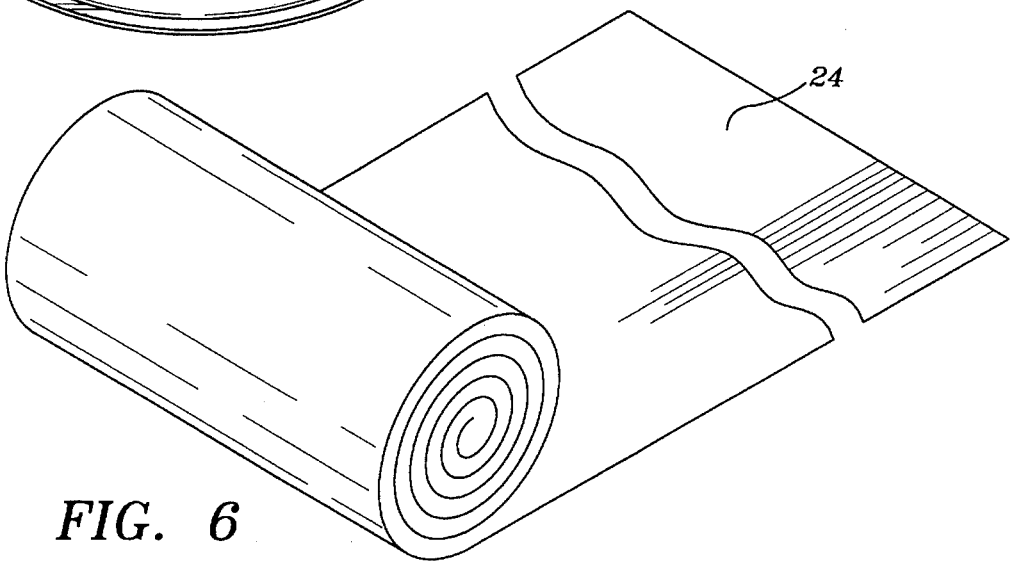
FIG. 6 is a simplified perspective view of a large roll of fiberglass material that can be brought to a job site and used to create the strips for a roof cover.

While the weight of a strip 24 that is 125 feet long may be manageable, its length is likely to be a different matter—if it must be kept linear. But by keeping the thickness of the strip 24 at less than 0.100 inch, and preferably within a range of about 0.065 to 0.070 inch, the strip can be readily bent (by hand) into a manageable roll. So while it is advantageous for the cover material to be delivered to a job site in a relatively large supply roll (i.e., one that is, say, 500 to 800 feet long, as suggested by FIG. 6), the process of installing a cover on top of a building will often begin with the step of cutting such a long strip into shorter, manageable strips 24. Of course, the hardness of the resin that is used to bind the fiberglass together will have a major effect on how well it can be bent and still maintain its structural integrity. So using a softer resin might make it possible to use sheet thicknesses significantly greater than 0.065 inch without losing too many of the benefits of the preferred, thin sheets.

Another step in the process, when required, is usually best handled on the ground, too. That step is the preparation of the edges of the strip so that they will more readily be able to bond to the narrow pieces that will eventually connect one strip to an adjacent strip. This edge preparation is sometimes needed because the equipment that is commonly used to fabricate the strips 24 produces a surface finish that is smooth and almost "slick." This almost-polished surface finish is present because the material being described herein as an excellent roofing material is similar to what has been long manufactured for use as interior wall panels for freezers, coolers and for the interior walls of semi-trailers, etc. But by buffing and/or sanding a narrow band 36 (e.g., about six inches wide) at the edges of each strip, there will little difficulty in achieving a good bond of fresh resin after the strips have been put into position on top of a building.

It should probably be mentioned here that the buffing/sanding step mentioned above would not likely be necessary if the strips 24 were to be produced with a matt or rough finish instead of a slick finish. So it should simply be kept in mind that eventually the longitudinal edges of adjacent strips will need to be sealingly connected together to form the larger cover 28; if and when some surface preparation should be needed, then it is probably best accomplished on the ground. Speaking of connecting strips together, this may be an apt place to mention that use of the terms "sheet," "piece," "panel," and "strip" are not intended to be limiting—as far as any particular size or shape is concerned. Of course, the word "panel" has a connotation of a planar member that is no larger than, say, a standard sheet of plywood (i.e., four feet by eight feet). And regardless of its total area, the word "strip" is commonly used to refer to something whose length is significantly greater than its width; and this is the sense in which the term is being used herein. But there really is no maximum or minimum length for a "strip" that is functional with this invention. Because the word "strip" might suggest to some persons something that is technically different than a "panel," and this might lead to confusion, the word "sheets" will often be used herein as a genetic way of referring to the rigid fiberglass members that are put together to make up the cover 28, regardless of the size or configuration of the individual members.

As will be thoroughly described later, there are some internal spots 30 on the strip 24, i.e., spots that are located well inside the edges, that are also advantageously buffed/sanded in order to improve their ability to bond with fresh resin. It is believed to be convenient to sand these spots 30 while the strip 24 is still on the ground and in a dry, protected work area. This may be a significant personal consideration for the comfort of a work crew, because the roofing process described herein is not limited to being practiced during the summer time. As long as it is reasonably dry outside, there is nothing about the process disclosed herein that would preclude it from being practiced in the winter, other than the fact that the use of polyester resin (as a part of the joining process) is not recommended below 40° F. So any preparatory work that can be done before a work crew climbs out onto an exposed and chilly roof in the winter may be greatly appreciated by the work crew. With continued reference to FIG. 1, there are shown extending transversely outward from one side of the strip 24 a plurality of ropes 26, each of which is lying loosely on top of the substrate 22 and under the fiberglass strip 24. In the practice of the preferred embodiment of the invention, each rope 26 is of uniform diameter (about ½ to ¾ inch) and made of a material which has a low friction coefficient, such as polyethylene or polypropylene. If the ropes do not have a naturally low coefficient of friction, it will likely be useful to apply a coat of wax or some other lubricant that will make it easier to pull the ropes over the substrate 22. The length of each rope will largely be a matter of choice, but 100 feet will probably be about right for most jobs. The purpose of the plurality of ropes 26 in this embodiment is to serve as temporary supports for portions of the strips 24 before they are permanently anchored to the substrate 22; and the ropes will be removed from under the strips before the cover is finalized. Now that the support function of the ropes 26 has been defined, it should become apparent to those skilled in the art that a variety of other removable supports might also be used. For example, a rope of smaller diameter (e.g., ¼ inch) could be used, provided that a series of knots is introduced every foot or so—to create some "bulk" that will be adequate to temporarily hold a portion of the strip 24 above the substrate 22. However, a large rope of uniform diameter will be less likely to become stuck on some part of the substrate than will a small rope with knots in it. Fortunately, though, if a rope ever does become stuck, a small opening for the purpose of freeing the rope can always be made at a nearby joint between two strips 24. After the rope has been freed, the opening can be patched in a conventional manner with fresh fiberglass and resin. As an alternative to solid ropes and the like, another embodiment involves the use of hydraulics or pneumatics to provide temporary support for a cover 28; this alternative embodiment is discussed later in the specification.

Of course, knots in a small rope, or other spacing devices that are adequate to hold portions of a cover in an elevated position, must be sufficiently sturdy to support a worker who is walking across an unfinished job and who steps on what may be called a high spot or "ridge" instead of a low spot or "valley." Workers will usually be encouraged to walk on clearly perceptible low spots during installation of a cover, in order to preclude any interference with the goal of maintaining suitable high spots until the cover is adequately anchored in place. But there may well be occasions when a worker may step on a region that is being temporarily supported by a rope 26; so it is believed that the rope (or its equivalent) should be able to support a vertical load of at least 25 pounds per square inch and remain intact. The function of the rope 26 as a vertical support for something laid on top of it is, of course, substantially different from the purpose for which a rope is usually used; hence, the rope's rated tensile strength will not likely be of great interest to persons practicing this invention. Indeed, the rope may even be considered to be little more than a series of "vertical spacers" that are tied together in a string-like fashion. Expressed in other words, the entire rope 26 may be considered to be a group of short rope segments that provide vertical support at the correct locations under a cover, and which are connected together so as to be removable as a unit when they have served their purpose.

If the width of a given building is more than the width of the transversely oriented ropes 26, the cover 28 would likely be prepared in segments, and the ropes would likely be pulled out from under a cover in increments that will leave at least part of the rope under the cover in a supporting role. By pulling on an exposed end of a rope 26, or pulling on a loop that is deliberately left where it is exposed between the abutting edges of two strips 24, the rope can eventually be completely withdrawn from under a cover; and any undulations or "waves" that were present when the cover 28 was being anchored to the substrate should still be present—at least in large part. As for the desired density of these waves, ripples, or ridges, it is believed that—as a general rule—they should be present about every ten or twelve feet along the length of a strip 24, and about every eight feet across the width of a strip, when the vertical spacers are adequate to produce a ridge of about ½ inch. However, the environment in which a cover is expected to operate will almost surely have some impact on the quantity and size of temporary supports that are employed with the invention. For example, in North Texas it is not really that unusual to have a year in which there is a 90° F. range in temperature between the hottest day in August and the coldest day in January. On the other hand, in habitable parts of Hawaii, the annual temperature range may be a much more modest 30° F. So a person who is expecting to put a waterproof cover on a building will be expected to take into account the temperature range for the area where the building will be sitting, as well as the time of year that the cover is being installed.

To say that it is important to consider the time of year when an installation is taking place is another way of acknowledging that thermal expansion and contraction are important when a roof is being planned. For example, if a first roof is being installed at a time when the weather averages 60° F. and a second roof is being installed in weather that averages 90° F., there should be more excess material "built into" the second roof, because it will inevitably experience greater total shrinkage if and when its temperature later goes down to 0° F. It follows, therefore, that larger temporary supports will normally be used on a hot day than on a cool day; for example, one or more ¾ inch ropes might be used in a particular area on a very hot day, while a single ⅝ inch rope might be used as a spacer on an equivalent job on a cool day.

Parts of two strips 24, shown side by side with their adjacent edges almost touching, are shown in FIG. 3. Also shown in FIG. 3 is a connecting strip 38 of fiberglass and resin that serves to rigidly connect one strip to an adjacent strip. This strip 38 is applied as an uncured (wet) medium after the strips 24 have been attached to the substrate 22 with a plurality of widely spaced anchors. A strip 38 that is about six to eight inches wide that is applied over a pair of bands 36, 36 that (in total) are about twelve inches wide will usually be about right to connect the two strips 24 together as a part of a unitary cover 28. The excess of band width over strip width is to ensure that there will not be any risk of an unsecured outer edge of the strip 38. As for the nature of the strip 38, it should possess enough resin and fiberglass to serve as both a waterproof joint and a structural link between two side-by-side strips.

Perhaps it should also be mentioned that the term "ridge" as used to describe an elevated portion of a cover 28 is not intended to be a precise technical term. In fact, some persons who have seen an experimental roof have used words such as "hump," "hill," and "bulge" to refer to the elevated parts of a cover, both when the parts are being temporarily supported by some device—and afterward. Also, it perhaps be mentioned that the location of a given "ridge" will not necessarily be a static thing. After the temporary supports have been eliminated and the elevated cover material is free to "float," a certain high spot on a given strip 24 may be immediately north of a row of anchors one one day and immediately south of it on a different day. This apparent movement of an occasional ridge seems to be almost random, but it is probably directly associated with temperature changes in the cover, the substrate, the roof substructure, and the building, as well as whether there has been any outside force imposed on the cover by having a person walk on it. But regardless of the absolute position of a particular elevated portion of a cover, the ability of a cover 28 to retain its waterproof character does not seem to be in any way affected.

Figure 4:
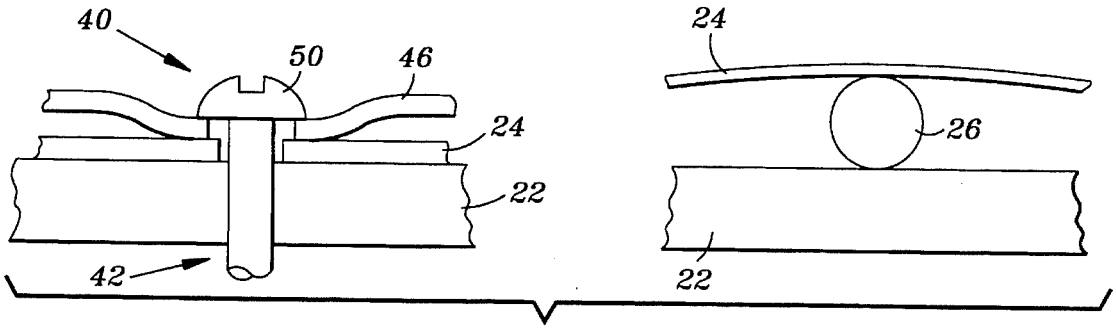
FIG. 4 is a side elevational view of a portion of a roof—with a cover in the process of being installed, and showing portions of the cover being temporarily supported by a rope laying on a supporting substrate.

An elevational view (at a different scale) of a cover being installed is shown in FIG. 4. Also shown is one of the anchors 40 that is used to secure the cover 28 to the underlying substrate—to protect the cover against wind loads that might tend to lift it away from the roof that is being covered. Referring additionally to FIG. 5, which is a cross-sectional view of an exemplary anchor 40 located between two strips 24, the several parts that make up an effective anchor are shown in an exploded view. Starting from the bottom, a screw 42 with a shank 44 is long enough to pass vertically through the top of an old roof cover and well into the substrate 22. If desired, new panels of insulation may be placed on top of the old roof; and they will be securely held under the new cover. At the top of the screw 42 is a relatively large washer 46 that has an outer diameter of about three inches; the washer also has a central hole 48 whose diameter is large enough to provide some significant clearance around the shank of the screw 42. By "significant clearance" it is meant at least 1/16 inch and preferably 1/8 inch or more. It is this clearance that fosters controlled shifting and/or movement of the cover 28 as a result of foundation shifting and normal temperature swings; and it is this clearance that precludes the creation of stresses that could fracture the cover and eventually contribute to water leaks. On the other hand, if the cover 28 is sufficiently hard and rigid, there may be enough force generated by temperature changes over a very large roof to shear off a fastener instead of fracturing the cover. So, the larger the clearance around a fastener, the greater will be the safety factor of permissible movement of the cover in directions that are generally parallel to the plane in which the cover lies.

The screw's head 50 is, of course, larger in diameter than the size of the central hole 48, and the head will inevitably protrude upwardly for a distance that may be as much as 1/8 inch. It is advantageous to provide a recess or dimple 52 in the washer 46, so that the top of the screw's head will not be too high above the top of the washer. Shown above the screw's head 50 is a piece of masking tape 54, which is applied to the top of the washer 46 during installation of the cover—after the screw has been driven into the substrate. The function of the tape 54 is to help preclude the passage of liquid resin downward around the screw's head 50 when a mixture of resin and fiberglass (used to form connecting strip 38) is laid on a joint between two adjacent strips. In a sense, the masking tape 54 may be considered to be simply a form of insurance; but it is believed to be prudent to guarantee that the cover will be permitted to "float" with relative freedom with respect to the substrate in response to shifting of the building or temperature changes, etc. If desired, masking tape may also be placed along the full length of the joint between two side-by-side strips 28, to protect against the entrance of wet resin (from strip 38) into whatever space may be present between two adjacent strips.

Anchors involving mechanical fasteners, washers, etc., are also provided at each of the previously prepared spots 30; such "internal" spots will normally not be any closer together than four feet, in order to allow for some modest movement (as a result of expansion and contraction) of the cover. The preferred density for anchors involving mechanical fasteners is in the range of about one to two anchors per square yard of surface area of the composite cover. A top view of a fragment of a cover 28 under construction is shown in FIG. 3, with transverse ropes 26 and longitudinal ropes 27 protruding out of from under the edges of the fragment, and anchors 40 being distributed in an orderly pattern along joints as well as "internally" of strips 24. Although it is not readily visible in this top view, the places where a transverse rope 26 crosses over a longitudinal rope 27 will be higher than than other places; and these high spots will help ensure that excess material is available to compensate for the contraction of a cover in a longitudinal direction as well as a transverse direction.

Figure 7:
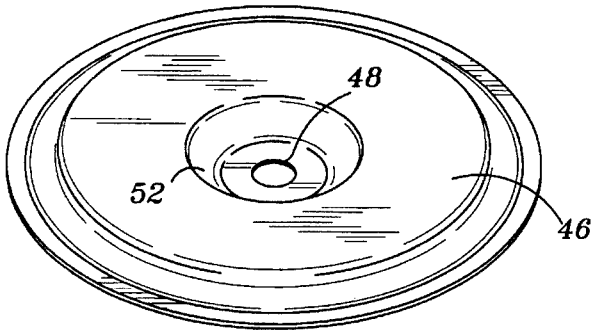
FIG. 7 shows a perspective view of a washer that has been selected for use under the head of a mechanical fastener, said fastener being intended for holding the cover to the substrate.

FIG. 7 shows a perspective view of a washer 46 for use under the head of a screw 42. But it should be kept in mind that essentially any kind of mechanical fastener ought to be serviceable with the invention disclosed herein. As long as ridges are built into the cover 28 to supply material for contraction, expansion, etc, and as long as them are mechanical fasteners to help sustain those ridges, then the advantages of practicing this invention should be realized.

Figure 8:
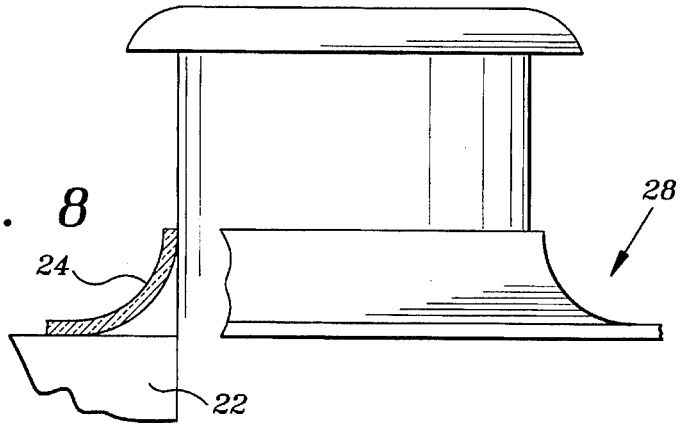
FIG. 8 is an elevational view, partially sectioned, of a section of the roof substrate and a portion of the waterproof cover that has been turned up alongside an exemplary air vent, to demonstrate how the cover can be effectively sealed against an air vent, a wall, a roof lip, etc.

When a strip 24 is being pulled across a roof and a vent or drain is encountered, the strip is cut and/or shaped to permit appropriate edges to be sealed (with resin or the like) around the vent or drain. This is represented in FIG. 8, where the edge of a strip 24 has been cut to fit the available space and bent up to rest against the sides of the air vent. These cover edges are then sealed around the air vent using a mixture of resin and fiberglass. In a like manner, the peripheral edges of the cover 28 will be sealed at the peripheral edges of the substrate 22, preferably with a combination of mechanical fasteners and a mixture of fiberglass and resin. But even though the finished peripheries of the cover and the substrate may be the same size, there actually will be slightly more material in the cover 28, because the substrate 22 will be essentially planar while the cover will have a plurality of deliberately induced ridges. Expressed in other words, the total area of the cover 28 will be just slightly larger than the area of the substrate 22, with the excess area being found in the ridges that protrude upwardly from the plane of the substrate's surface.

Figure 9:
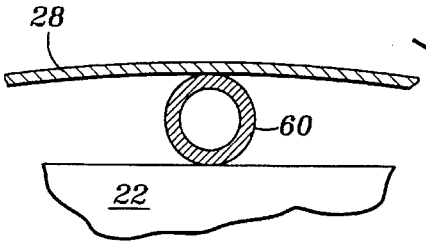
FIG. 9 is a cross-sectioned elevational view of an elongated bladder being used as an alternative to a long rope for holding a sheet above a substrate.
Figure 10:
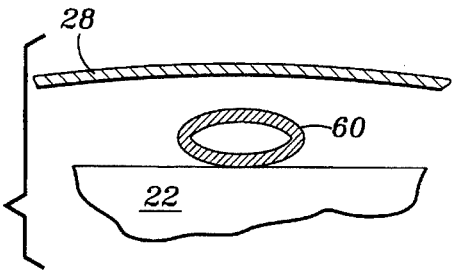
FIG. 10 is a cross-sectioned elevational view similar to FIG. 9, but showing the bladder deflated, such that a portion of the cover over the bladder may be said to be "floating" over the substrate.

Turning next to FIGS. 9 and 10, an alternate embodiment of the invention is disclosed in which an elongated bladder 60 is placed on top of a substrate 22 in the same manner that an exemplary rope 26 was positioned in the earlier embodiment. In FIG. 9 the bladder 60 is shown inflated, with pressurized air or a liquid such as water; and the cover 28 is obviously being held well above the upper surface of the substrate. If air is selected as the pressurizing medium, an air compressor can be used to selectively inflate the bladders; and an air compressor will almost always be available at a major construction site. If water is selected as the pressurizing medium, the normal water pressure in a city's water pipes will usually be enough to pressurize a plurality of bladders and achieve the desired lifting. In FIG. 9 the anchors have already been set, for the purpose of holding the cover in place; and the pressurizing fluid has been removed from the bladder 60, so that the lifting effect of the bladder has also been removed. Whether the bladder itself is physically removed from under the cover is of little significance, as long as it has done its temporary lifting job and has then been deflated. So if the elongated bladder 60 can be economically manufactured in the manner of a flat water hose for residential use, there may be occasions when a roofer thinks it will be cheaper to simply abandon a set of empty bladders under a cover than to take the time and trouble to recover them.

In one sense, the combination that has been described herein comes close to the offering the advantages that are present in our own bodies, wherein bones provide structural support for our arms, legs, etc., while relatively loose skin provides a waterproof cover for the bones. Our bones are essentially rigid, and it is contemplated that the substrate of a building's roof will also be as rigid as possible. And in the same manner that our flexible skin covers and protects our rigid bones, the cover 28 is expected to cover and protect the supporting substrate 22 from exposure to rain, snow, dust and other environmental conditions. We can touch an arm and achieve relative movement between the skin and an underlying bone; and there is a parallel effect in the construction disclosed herein. By providing excess material in the cover 28, and anchoring it in such a way as to ensure that it can realize at least some "sideways" movement, a person who is walking on a completed roof may even get the sensation of walking on a slightly unstable medium, because there is an occasional feeling of very slight movement underfoot. And if our skin suffers a minor tear, we can treat it without having to perform major surgery. Similarly, if and the repair of a cover 28 ever becomes necessary (to ensure its integrity as a barrier to moisture), the repair can probably be managed by one man working alone, eliminating the need to call on a large work crew and arrange parking space for large, smelly equipment.

One reason that any needed repairs to a cover 28 are likely to be so easy is that there is a very close correlation between what the eye can see and what is actually happening, as far as excluding moisture is concerned. That is, any crack in the cover 28 that might constitute a leak will usually be clearly visible to the naked eye. This contrasts favorably with built-up roof coverings, because there is often so much gravel on top of the upper asphalt layer that the true condition of the roof tends to be obscured. The ability to accomplish a visual inspection of a completed roof can be enhanced by putting a thin elastomeric coating on top of the cover 28 after all of the sheets have been connected and all anchors installed, etc. Such an elastomeric coating, with an additive to resist UV radiation and perhaps a whitener like titanium dioxide, will usually cause cracks in the cover to be as visible as the proverbial sore thumb. A whitener will also contribute to a cooler building in the summertime, because it will improve the ability to reflect radiant energy from the sun instead of absorbing that energy like a dark asphalt roof will do. Hence, the optional addition of such an elastomeric coating is a preferred step in achieving an optimum waterproof covering for a building.

While only a few ways of practicing the invention have been disclosed herein in great detail, those skilled in the art will no doubt recognize that there are variations that could be made without departing from the general concept of the invention. For example, the temporary support of a cover while it is being anchored has been described as being best accomplished with a plurality of small supports (in the form of ropes) spaced several feet apart. But with a waterproof cover of different thickness and stiffness, it may be advantageous to use fewer supports but make them larger than the preferred ½ to ¾ inch. Also, it is preferred to manually pull the supporting ropes 26 out from under a completed segment of a cover 28 one rope at a time, because it helps ensure that there will not be any application of a pulling force that could be destructive to any part of a roofing system (if something should become temporarily stuck). That is, when people are pulling on a rope, they can easily sense if and when a rope has become stuck and needs to released in some manner. But this does not mean that a powered withdrawal system might not be feasible, with more than one rope being withdrawn at the same time. This disclosure has also focused on the advantages of using a particular size and type of sheet material with which to fabricate the waterproof cover. But this is not intended to preclude the use of some other kind of material—as long as it has the ability to form and maintain the elevated ridges (between anchors) that will help protect against destructive stress in the cover as a result of temperature changes, etc. Thus, it should be understood that numerous variations and modifications could be made in the invention without departing from the general concept that has been disclosed herein. The invention should therefore be considered to be limited only by the scope of the claims appended hereto.

What is claimed is:

1. The method of waterproofing the roof of a building, said roof having a generally planar substrate with an exposed upper surface and having structural characteristics that render it capable of permanently supporting a waterproof cover, comprising the steps of:

a. attaching a thin and relatively stiff waterproof cover to the generally planar substrate at a plurality of widely spaced locations that are distributed across the surface of the substrate;

b. providing in the waterproof cover a plurality of ridges including a ridge between at least most of the locations where the cover is attached to the substrate, said plurality of ridges being formed by temporarily providing substantially rigid supports under the cover above the substrate at certain spaced locations while the cover is being attached to the substrate at locations that are not being supported; and c. eliminating the temporary supports from under the cover after the cover has been attached to the substrate.

2. The method of waterproofing the roof of a building as claimed in claim 1 wherein the cover is temporarily supported above the substrate by allowing the cover to rest on top of a rope that is laid on top of the substrate.

3. The method of waterproofing the roof of a building as claimed in claim 1 wherein the cover is temporarily supported above the substrate with at least one rope of essentially uniform diameter, and wherein the elimination of the temporary support involves the step of manually pulling said at least one rope from under the cover.

4. The method of waterproofing the roof of a building as claimed in claim 1 wherein the cover is temporarily supported above the substrate by a distance within the range of about ½ to ¾ inch, such that the resulting ridges will be within the range of about ½ to ¾ inch.

5. The method of waterproofing the roof of a building as claimed in claim 1 wherein the cover is attached to the generally planar substrate with mechanical fasteners in a way that permits at least some relative movement between the cover and the substrate in directions that are generally parallel to the substrate's surface, such that at least some thermal expansion and contraction of the cover can be accommodated by virtue of the manner in which the mechanical fasteners secure the cover to the substrate.

6. The method of installing a waterproof cover on the roof of a building, said cover being made up from the combination of a plurality of sheets, said roof having a generally planar substrate and having structural characteristics that render it capable of permanently supporting a waterproof cover and also serving as a structural anchor for mechanical fasteners, comprising the steps of:

a. distributing across the upper surface of the generally planar substrate a plurality of removable supports, each support having a size that is adequate to temporarily hold portions of a sheet above the generally planar substrate by a distance of at least one-half inch, and the removable supports being arranged in a pattern that will cause portions of a sheet to be elevated above adjacent portions, such that a given sheet in contact with the supports may be aptly described as having both raised portions and low portions, and said supports having the strength to support a substantial compressive load without collapsing;

b. distributing a plurality of relatively stiff waterproof sheets across the upper surface of the generally planar substrate in such a way that the edges of adjacent sheets will abut one another, and placing some portions of the sheets in contact with the plurality of removable supports and allowing other portions of the sheets to rest directly on the generally planar substrate, such that the combination of the raised and low portions may be aptly described as having a wavy appearance when examined at a position adjacent the plurality of sheets and looking in a direction that is essentially parallel to the plane of the building's roof;

c. connecting together those edges of the plurality of sheets that abut one another, and said connecting step involving the making of waterproof joints so as to form a composite waterproof cover; and d. removing from under the composite waterproof cover the plurality of removable supports after the plurality of sheets have been connected together to form the composite cover, whereby at least some of the raised portions that were in the stiff composite cover when the removable supports were present will become unsupported and essentially free-floating ridges, and whereby the presence of unsupported and free-floating ridges contribute to the availability of material that compensates for any shrinkage that may occur in the composite cover when said cover is subjected to cold weather.

7. The method as claimed in claim 6 wherein at least some of the plurality of removable supports are linearly aligned and connected together, such that the connected supports are removable as a unit after the sheets have been connected together to form a composite cover.

8. The method as claimed in claim 6 wherein at least some of the plurality of removable supports are linearly aligned and connected together as undivided segments of a unitary and elongated body having two ends, such that the elongated body may be removed by pulling on one end of the body after the sheets have been connected together to form a composite cover.

9. The method as claimed in claim 6 wherein at least some of the plurality of removable supports constitute serially aligned and connected segments of a rope, and the rope is long enough to extend sideways across a plurality of connected sheets, such that the rope may be removed from under the sheets by pulling on one end of the rope after the sheets have been connected together.

10. The method as claimed in claim 6 wherein at least some of the plurality of removable supports constitute serially aligned and connected segments of a rope, and the connection between serially aligned segments being visible as loops at outer edges of the connected sheets, and wherein at least one gap is temporarily left in the connections between adjacent sheets, and wherein the rope is removed from under the cover by pulling an exposed loop of the rope through said at least one temporary gap, and including the step of closing the gap after the rope has been removed from under the sheets.

11. The method as claimed in claim 6 and including the further step of anchoring the sheets to the generally planar substrate at widely spaced locations by use of mechanical fasteners, and the density of the anchored locations being in the range between one and two fasteners per square yard of surface area of the composite cover.

12. The method as claimed in claim 6 wherein the composite cover is anchored to the generally planar substrate of the roof at scattered locations across the roof, and the anchored locations are fabricated in such a way as to foster at least some relative movement between the composite cover and the generally planar substrate without rupturing the waterproof cover.

13. The method as claimed in claim 6 wherein the sheets are resin-impregnated sheets of fiberglass having a nominal thickness of about 0.065 inch, and wherein the joints between adjacent sheets are made by placing on top of the joints a wet mixture of fiberglass fibers, polyester resin and a catalyst which will cause the resin to harden, and then allowing said mixture to harden.

14. The method as claimed in claim 6 wherein the sheets are initially fabricated as portions of very long strips of resin-impregnated fiberglass that are of finite width and are handled as large rolls, and wherein the sheets are formed into working lengths by cutting material off of the very long strips.

15. The method as claimed in claim 14 wherein the very long strips of resin-impregnated fiberglass are initially about eight feet wide and at least 500 feet long.

16. The method as claimed in claim 14 wherein the removable supports constitute serially connected segments of a rope, and the rope is long enough to extend across at least a major portion of the roof, and wherein the rope is placed on top of the generally planar substrate before long strips of resin-impregnated fiberglass are subsequently positioned in such a way that they will rest on top of the rope.

17. The method as claimed in claim and including the further step of sealing the edges of the waterproof cover to the edges of the roof by a combination of mechanical fasteners and a mixture of fiberglass fibers and polyester resin.

18. The method as claimed in claim 6 wherein the roof has at least one air vent for fostering the passage of air out of the building, and wherein the waterproof cover is sealed around the air vent by use of a mixture of fiberglass fibers and polyester resin.

19. A roof construction for waterproofing the top of a building, said building having a substrate that is sufficiently sound as to both support a waterproof cover and anchor the cover against unwanted movement, and the substrate having an upper surface of given area, and said upper surface defining a general plane, and the roof being subject to expansion and contraction as a result of temperature changes, comprising:

a. a waterproof cover formed of a relatively thin and generally stiff material having an area that is just slightly larger than the substrate that is to be covered, and that portion of the cover's area that is larger than the substrate's area being waterproofed in the form of ridges that protrude upwardly from the plane of the substrate's upper surface, and the relatively thin and generally stiff material constituting a resin-impregnated fiberglass sheet having a nominal thickness of about 0.065 inch;

b. a plurality of anchors that are distributed across the substrate's upper surface for holding the cover to the substrate, and the anchors being arranged in a pattern that causes the cover's ridges to be maintained between adjacent anchors; and c. means for accommodating at least some relative movement between the cover and the substrate when the cover experiences thermal expansion and contraction.

20. The roof construction as claimed in claim 19 wherein the ridges protrude upwardly from the plane of the substrate for a distance within the range of about ½ to ¾ inch.

* * * * *